US009471041B2

(12) United States Patent
Racine et al.

(10) Patent No.: US 9,471,041 B2
(45) Date of Patent: Oct. 18, 2016

(54) METHOD OF ALIGNING A CRYSTAL RELATIVE TO THE MIDDLE PART OF A TIMEPIECE

(71) Applicant: ETA SA Manufacture Horlogere Suisse, Grenchen (CH)

(72) Inventors: Christian Racine, Malleray-Bevilard (CH); Martin Jufer, Melchnau (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 8 days.

(21) Appl. No.: 14/188,985

(22) Filed: Feb. 25, 2014

(65) Prior Publication Data

US 2014/0241135 A1 Aug. 28, 2014

(30) Foreign Application Priority Data

Feb. 26, 2013 (EP) ..... 13156763

(51) Int. Cl.

| | |
|---|---|
| ***G04B 39/00*** | (2006.01) |
| ***G04G 17/04*** | (2006.01) |
| ***G04D 7/00*** | (2006.01) |
| ***G04G 17/02*** | (2006.01) |

(52) U.S. Cl.

CPC ..... *G04D 7/00* (2013.01); *G04B 39/00* (2013.01); *G04G 17/02* (2013.01); *G04G 17/04* (2013.01); *G04G 17/045* (2013.01); *Y10T 29/49002* (2015.01)

(58) Field of Classification Search

CPC .... G04B 17/02; G04B 39/00; G04B 39/002; G04B 39/004; G04G 17/02; G04G 17/04; G04G 17/045; G04D 7/00; Y10T 29/49002

USPC ..... 368/309–312

See application file for complete search history.

(56) References Cited

U.S. PATENT DOCUMENTS

| | | | | |
|---|---|---|---|---|
| 1,718,228 | A * | 6/1929 | Gleason | 368/294 |
| 3,861,135 | A * | 1/1975 | Seeger, Jr. | G02F 1/13452 174/88 R |
| 3,883,213 | A * | 5/1975 | Glaister | H01R 13/2414 349/152 |

(Continued)

FOREIGN PATENT DOCUMENTS

| | | |
|---|---|---|
| CH | 704 453 A2 | 8/2012 |
| EP | 1 122 620 A1 | 8/2001 |

(Continued)

OTHER PUBLICATIONS

European Search Report issued Jul. 3, 2013, in European Application No. 13 15 6763 filed Feb. 26, 2013 (with English Translation).

*Primary Examiner* — Sean Kayes

(74) *Attorney, Agent, or Firm* — Oblon, McClelland, Maier & Neustadt, L.L.P.

(57) ABSTRACT

The invention concerns a timepiece including a case, formed by a middle part 5 closed by a back cover and by a crystal 9, said crystal 9 being supported on a bearing surface of the middle part 5, parallel to said back cover, said case forming a housing in which an electronic module 13 is placed; said timepiece further includes a display module fixed to the crystal 9, the electronic module 13 and the display module include an identical number of connection points so that electrical connection means can connect the connection points of the electronic module 13 to the connection points of the display module in pairs.

32 Claims, 3 Drawing Sheets

(56) References Cited

U.S. PATENT DOCUMENTS

| | | | | |
|---|---|---|---|---|
| 3,905,666 | A | 9/1975 | Grimm et al. | |
| 4,060,971 | A * | 12/1977 | O'Connor | G04C 3/001 361/679.01 |
| 4,196,577 | A | 4/1980 | Ohno et al. | |
| 4,281,406 | A | 7/1981 | Tanaka | |
| 5,901,117 | A * | 5/1999 | Delabre | 368/276 |
| 6,053,631 | A * | 4/2000 | Mock et al. | 368/281 |
| 2013/0098546 | A1 | 4/2013 | Racine et al. | |

FOREIGN PATENT DOCUMENTS

| | | |
|---|---|---|
| EP | 2 477 084 A1 | 7/2012 |
| EP | 2 584 413 A1 | 4/2013 |

* cited by examiner

METHOD OF ALIGNING A CRYSTAL RELATIVE TO THE MIDDLE PART OF A TIMEPIECE

This application claims priority from European patent application No. 13156763.8 filed Feb. 26, 2013, the entire disclosure of which is hereby incorporated by reference.

The invention concerns a timepiece including a case 3, formed by a middle part closed by a back cover and by a crystal, said crystal being supported on a bearing surface of the middle part, parallel to said back cover, said case forming a housing in which an electronic module is placed; said timepiece further includes a display module fixed to the crystal, the electronic module and the display module include an identical number of connection points so that electrical connection means can connect the connection points of the electronic module to the connection points of the display module in pairs.

BACKGROUND OF THE INVENTION

There are known timepieces, such as watches, formed of a plastic middle part closed by a crystal and a back cover to form a watch case. The watch crystal, which may be plastic, includes a top surface facing the user side and a bottom surface, opposite the top surface, with a digital display device being bonded to the bottom surface of the crystal. The crystal is welded to the watch middle part by means of a laser beam. This timepiece includes an electronic module placed inside the watch case. The electronic module, such as an LCD module, includes a plurality of connection points which have to be connected to a plurality of connection points arranged on the digital display device. A zebra type connector is then used to electrically connect the digital display device and the electronic module. The connection points of the digital display device and the connection points of the electronic module are arranged to be opposite each other to simplify the connection.

The current assembly method has manufacturing tolerances. This means that the crystal, to which the electronic module is fixed, can be fixed to the middle part with slight offsets. Consequently, the electronic module connection points and the display module connection points may not be perfectly aligned. This may not be a problem if the connection points are spaced apart.

However, with a high density of connection points, the error margins during assembly may cause a significant offset between the connection points. Consequently, it is possible that one or more electronic module connection points and display module connection points required to be connected to each other can no longer be connected. The assembly formed of crystal 9 and the electronic module therefore has to be dismantled and reassembled or, in the worst case, considered scrap. Production rates are thus lower and costs increase accordingly.

SUMMARY OF THE INVENTION

It is an object of the invention to overcome the drawbacks of the prior art by proposing to provide a timepiece wherein the connection points of the LDC module fixed to the crystal are perfectly aligned with the connection points of the electronic module of said timepiece.

The present invention therefore concerns a timepiece including a case, formed by a middle part closed by a back cover and by a crystal, said crystal being supported by a bearing surface of the middle part parallel to said back cover, said case forming a housing in which an electronic module is placed, said timepiece further including a display module fixed to the crystal, the electronic module and the display module respectively include first connection points and second connection points so that the electrical connection means can connect the first connection points to the second connection points in pairs, characterized in that said case is further provided with an alignment means including first alignment elements arranged on the middle part and second alignment elements arranged on the crystal arranged to cooperate with each other, the first alignment elements or the second alignment elements being formed so that the first connection points and the second connection points required to be connected to each other in pairs are located facing each other.

In a first advantageous embodiment, the first alignment elements include at least two studs, the second alignment elements include a number of recesses at least identical to the number of studs, the second alignment elements being positioned on said crystal so that the electronic module connection points and the display module connection points required to be connected to each other in pairs are located facing each other.

In a second advantageous embodiment, the first alignment elements include at least two recesses, the second alignment elements include a number of studs at least identical to the number of recesses, the first alignment elements being positioned on said crystal so that the electronic module connection points and the display module connection points required to be connected to each other in pairs are located facing each other.

In a third advantageous embodiment, said crystal includes at least two lugs each extending from one of the sides of the crystal, said second alignment elements being arranged on said at least two lugs.

In another advantageous embodiment, the at least two recesses are circular.

In another advantageous embodiment, one of the at least two recesses is circular, the other being oblong.

This timepiece has the advantage of having recesses made in the crystal specifically according to any possible offsets.

The present invention also concerns a method of assembling a timepiece including a case, formed by a middle part closed by a back cover and by a crystal, defining a housing, said method including the following steps:

a) taking an electronic module including first connection points and placing the electronic module in said housing;

b) taking a crystal having an external face and a bottom face onto which a display module having second connection points is fixed, the second connection points being required to cooperate with the first connection points;

characterized in that said method further includes the following steps:

c) determining the position of at least one stud arranged on the middle part in relation to the first connection points;

d) determining the position of the display module relative to the crystal;

e) forming at least one recess in the crystal according to the position of said at least one stud arranged on the middle part relative to the first connection points; and f) placing the crystal on the middle part causing said at least one stud to cooperate with said at least one recess and rendering said crystal integral with said middle part.

In another embodiment of the method of assembling a timepiece including a case, formed by a middle part closed by a back cover and by a crystal defining a housing, said method includes the following steps:

a) taking an electronic module including first connection points and placing the electronic module in said housing;

b) taking a crystal having an external face and a bottom face onto which a display module having second connection points is fixed, the second connection points being required to cooperate with the first connection points;

said method further includes the following steps:

c) determining the position of at least one stud arranged on the crystal relative to the second connection points;

d) determining the position of the electronic module relative to the middle part;

e) forming at least one recess in the middle part according to the position of said at least one stud arranged in the crystal relative to the second connection points; and f) placing the crystal on the middle part causing said at least one stud to cooperate with said at least one recess and rendering said crystal integral with said middle part.

The invention also concerns a method of assembling a timepiece including a case, formed by a middle part closed by a back cover and by a crystal defining a housing, said method including the following steps:

a) taking an electronic module including first connection points and placing the electronic module in said housing;

b) taking a crystal having an external face and a bottom face onto which a display module having second connection points is fixed, the second connection points being required to cooperate with the first connection points;

characterized in that said method further includes the following steps:

c) determining the position of the display module relative to the crystal;

d) forming at least one recess in the crystal according to the known position of said at least one stud arranged on the middle part relative to the first connection points; and e) placing the crystal on the middle part causing said at least one stud to cooperate with said at least one recess and rendering said crystal integral with said middle part.

In another embodiment of the method of assembling a timepiece including a case, formed by a middle part closed by a back cover and by a crystal defining a housing, said method includes the following steps:

a) taking an electronic module including first connection points and placing the electronic module in said housing;

b) taking a crystal having an external face and a bottom face onto which a display module having second connection points is fixed, the second connection points being required to cooperate with the first connection points;

characterized in that said method further includes the following steps:

c) determining the position of the electronic module relative to the middle part;

d) forming at least one recess in the middle part according to the known position of said at least one stud arranged on the crystal relative to the second connection points; and e) placing the crystal on the middle part causing said at least one stud to cooperate with said at least one recess and rendering said crystal integral with said middle part.

In another embodiment, step c) for determining the position of at least one stud arranged on the middle part relative to the first connection points consists in making an optical image of the middle part and in measuring the distance of the first connection points relative to said at least one stud acting as a reference.

In another embodiment, step c) for determining the position of at least one stud arranged on the crystal relative to the second connection points consists in making an optical image of the crystal and in measuring the distance of the second connection points relative to said at least one stud acting as a reference.

In another embodiment, the step for determining the position of the display module relative to the crystal consists in making an optical image of the crystal.

In another embodiment, the step for determining the position of the electronic module relative to the middle part consists in making an optical image of the middle part.

In another embodiment, the number of studs is identical to the number of recesses.

In another embodiment, the middle part has two studs and the crystal has two recesses.

In another embodiment, the middle part has two recesses and the crystal has two studs.

BRIEF DESCRIPTION OF THE DRAWINGS

The objects, advantages and features of the timepiece and of the method according to the present invention will appear more clearly in the following detailed description of at least one embodiment of the invention, given solely by way of non-limiting example and illustrated by the annexed drawings, in which.

DETAILED DESCRIPTION OF THE INVENTION

Figure 1:
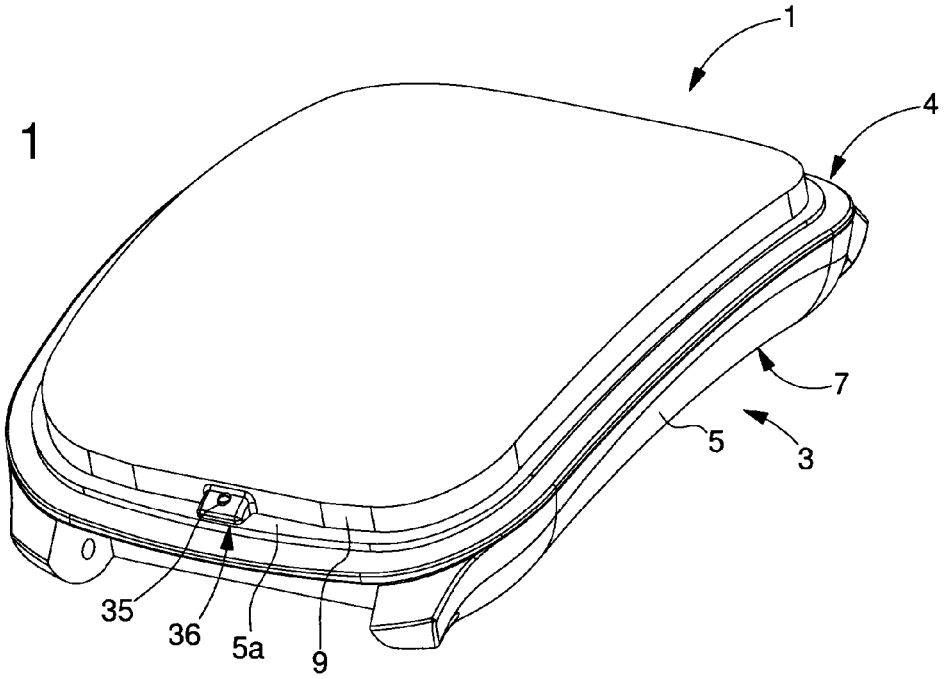
FIG. 1 is a schematic view of a timepiece according to the invention.

FIG. 1 shows a cross-section of the timepiece 1 according to the invention. This timepiece 1 includes a case 3. The case 3 is formed of a middle part 5 closed by a back cover 7 and by a crystal 9. Crystal 9 includes an inner face 9*a* and an outer face 9*b*. Middle part 5 has at least one bearing surface 5*a* which supports crystal 9, on the inner surface thereof, when the crystal is fixed to middle part 5. In the case of FIG. 1, where middle part 5 has a substantially rectangular shape, said middle part 5 has a single bearing surface 5*a* surrounding said middle part 5. This bearing surface 5*a* thus extends parallel to the back cover of case 3. It is possible to envisage that middle part 5 and back cover 7 are in one and the same piece.

Case 3 forms a housing 11 in which an electronic module 13 is placed. Electronic module 13 is the module controlling the various functions of timepiece 1 such as the provision of time-related information, a chronograph function, an alarm or other function. Electronic module 13 is powered with energy by a battery or accumulator supplying the necessary electrical energy.

Electronic module 13 is provided with a plurality of connection points 15. Among this plurality of connection points 15, first connection points 17 are used for the display. The information provided by electronic module 13 is displayed by a display module 19 such as an LCD module 20. LCD module 20 is fixed to crystal 9 of timepiece 1 and more specifically to the inner face 9*a* of crystal 9. Display module 19 includes second connection points 21 for connecting said display module 19 to electronic module 13 of timepiece 1.

Figure 2:
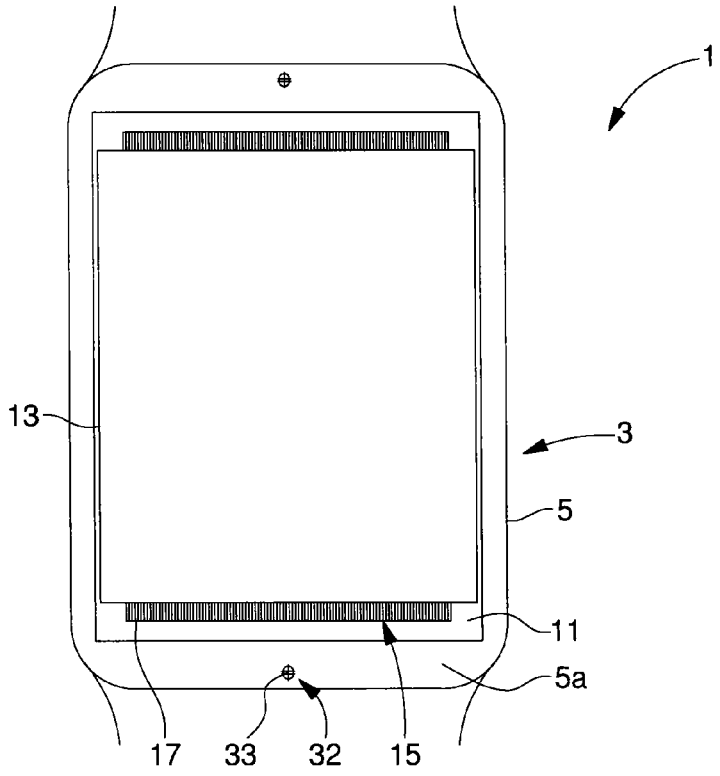
FIG. 2 is a schematic top view of the timepiece without the crystal according to the invention.

It is therefore clear that the number of first connection points 17 is identical to the number of second connection points 21. First connection points 17 and second connection points 21 may each be divided into several groups of connection points spread over electronic module 13 or LCD module 20. Preferably, the distribution of first connection points 17 is identical to that of second connection points 21. In the case of FIG. 2, it will be noted that first connection points 17 and second connection points 21 are disposed in lines on two opposite surfaces of the crystal.

LCD module 20 is fixed to bottom face 9*a* of crystal 9 by various securing techniques such as laser welding, brazing or adhesive bonding.

Thus, when timepiece 1 is assembled, a first step consists in taking the assembly 4 formed by middle part 5 and back cover 7 and placing electronic module 13 therein.

In a second step, display module 19, i.e. LCD module 20 is fixed to crystal 9. For example, LCD module 20 is fixed by adhesive bonding to crystal 9. This step thus consists in taking crystal 9, placing it on a support so that the inner face 9*a*, to which LCD module 20 will be fixed, is oriented upwards and in placing LCD module 20 on crystal 9. Once LCD module 20 is in the proper position, the adhesive bonding operation is performed automatically by a machine. The proper position is the position in which the first connection points 17 and second connection points 21 face each other when crystal 9 is fixed to middle part 5.

In the third step, crystal 9 is fixed to middle part 5 of the timepiece. To achieve this, crystal 9 carrying LCD module 20 is placed on bearing surface 5*a* of middle part 5 in a predefined position. Once crystal 9 is in this predefined position, the crystal is permanently fixed to middle part 5 by a laser welding or brazing method or by any other method that may be envisaged, such as adhesive bonding. Of course, a cap may be placed above crystal 9 to conceal the join between said crystal 9 and middle part 5.

Advantageously according to the invention, the timepiece is provided with an alignment means 30. Alignment means 30 includes first alignment elements 32 and second alignment elements 34. First alignment elements 32 are arranged on timepiece middle part 5, whereas second alignment elements 34 are arranged on crystal 9.

First alignment elements 32 include at least two studs 33. Studs 33 are arranged on bearing surface 5*a* of middle part 5 and extend perpendicularly to the plane of said bearing surface 5*a*. Second alignment elements 34 include at least two recesses 35 located on crystal 9. It will be clear that the number of recesses 35 is identical to the number of studs 33. Consequently, when the timepiece is assembled, crystal 9, to which LCD module 20 is fixed, is placed on middle part 5 so that studs 33 are inserted into recesses 35 of crystal 9, as seen in FIG. 1. This has the advantage of preventing any movement of crystal 9 relative to middle part 5. Therefore, when crystal 9 is permanently fixed to middle part 5 in the third step, the position of crystal 9 does not vary.

Even more advantageously, the invention provides for recesses 35 to be made in crystal 9 after the second step during which LCD module 20 is fixed to crystal 9. The present invention proposes that the recesses in crystal 9 are made to compensate for any variation in the position of LCD module 20 relative to crystal 9. Indeed, when LCD module 20 is fixed to crystal 9, it is possible for stresses to be exerted on LCD module 20 resulting in a variation in the position of said LCD module 20 relative to crystal 9. Likewise, the position of electronic module 13 relative to the assembly formed by middle part 5 and back cover 7 may vary.

To compensate for this position error, the assembly method provides an additional step performed between the second step and the third step. This step thus consists in taking optical measurements and comparing them.

Figure 3:
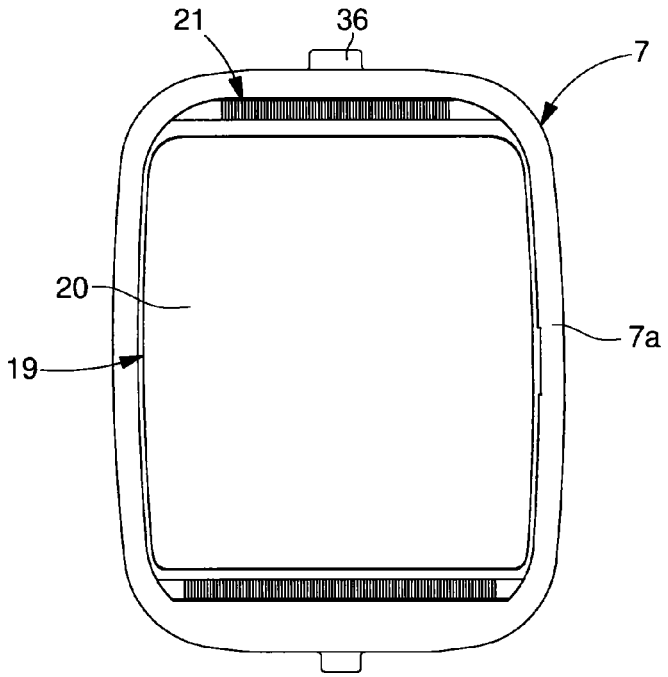
FIG. 3 is a schematic top view of the crystal 9 of the timepiece according to the invention.

More specifically, a first sub-step consists in making optical images of crystal 9 provided with LCD module 20 and of middle part 5 provided with electronic module 13, i.e. in determining the position of electronic module 13 relative to middle part 5. Indeed, it will be noted in FIGS. 2 and 3 that first connection points 17 and second connection points 21 are arranged to form a row or line. The first connection points 17 may thus be arranged to include a connection point A located at a first end of the row formed by first connection points 17 and a connection point B located at a second end of the row formed by first connection points 17. This image allows the position of connection points A and B to be defined relative to a reference. In the present case, the reference in question is the axis passing through the two studs.

A second sub-step then consists in forming the recesses in crystal 9 according to the images made. To achieve this, second connection points 21 may be arranged to include a connection point X located at a first end of the row formed by second connection points 21 and a connection point Y located at a second end of the row. It will be clear that connection point X must be connected to connection point A and that connection point Y must be connected to connection point B. The recesses are then made in crystal 9 so that the position of connection points X and Y relative to the axis passing through the two recesses 35 is the same as the position of connection points A and B relative to the axis passing through the two studs 33.

Consequently, when crystal 9 is assembled on middle part 5 of timepiece 1, first connection points 17 and second connection points 21 will be certain to be perfectly aligned. The assembly method therefore includes the following steps:

a) taking an electronic module 13 including first connection points 17 and placing the electronic module in said housing;

b) taking a crystal 9 having an external face and a bottom face onto which a display module having second connection points is fixed, the second connection points being required to cooperate with the first connection points;

c) determining the position of at least one stud arranged on the middle part in relation to the first connection points 17;

d) determining the position of the display module relative to the crystal.

e) forming at least one recess in the crystal according to the position of said at least one stud arranged on the middle part relative to the first connection points 17; and f) placing crystal 9 on middle part 5 causing said first alignment elements to cooperate with said second alignment means and rendering said crystal 9 integral with said middle part 5.

Of course, in the event that the studs are formed on the crystal and the recesses are formed in the middle part, steps c), d), e) and f) of the method are modified accordingly.

Likewise, it is possible to envisage that second connection points 21 are only arranged on one surface of crystal 9.

In a preferred version, electronic module 13 is placed in the assembly formed of middle part 5 and the back cover with absolute precision so that variations in position are impossible and non-existent. In that case, it will be noted that the distance between connection point A and the axis passing through the two studs 33 is identical to the distance between connection point B and said axis. Consequently, recesses 35 are pierced in crystal 9 so that the distance between connection point X and the axis passing through the two recesses 35 is identical to the distance between connection point Y and said axis. The method is thus as follows.

a) taking an electronic module 13 including first connection points 17 and placing the electronic module in said housing;

b) taking a crystal 9 having an external face and a bottom face onto which a display module 19 having second connection points 21 is fixed, the second connection points being required to cooperate with the first connection points;

c) determining the position of electronic module 13 relative to middle part 5;

d) forming at least one recess 35 in the middle part according to the known position of at least one stud 33 arranged on crystal 9 relative to second connection points 17; and e) placing crystal 9 on middle part 5 causing said at least one stud 33 to cooperate with said at least one recess 35 and rendering said crystal integral with said middle part.

This preferred version has the advantage of providing a quicker and more flexible assembly method. This means that it is possible not to make the image of electronic module 13 and only to make the image of crystal 9. Time is saved if these two images are taken in parallel, and a machine is saved if the two images are taken in succession. Further, this version provides greater flexibility. This flexibility arises on the one hand from the fact that in all the assemblies formed by middle part 5 and the back cover, the position of electronic module 13 is perfectly identical. The recesses of each crystal 9 are pierced to be compatible with the arrangement of electronic module 13 relative to the axis passing through the two studs 33. Consequently, each crystal 9 pierced with two recesses 35 may in theory be associated with any middle part 5—back cover 7 assembly provided with an electronic module 13. Conversely, if recesses 35 of each crystal 9 are made to be compatible with only one middle part 5—back cover assembly provided with an electronic module 13, there is no flexibility or interchangeability.

Figure 4:
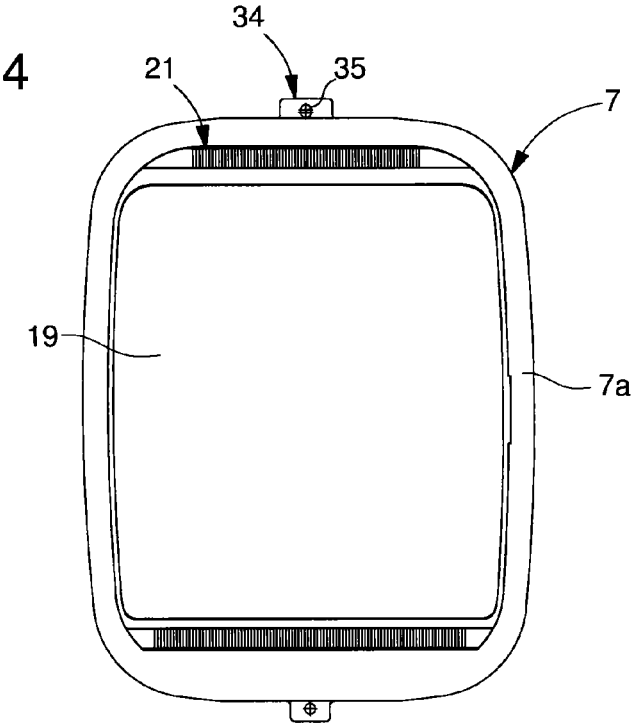
FIG. 4 is a schematic top view of the timepiece crystal once the method of the invention has been carried out.

In a first variant of the invention, each crystal 9 is provided with a pair of projecting portions, such as lugs 36 each extending from one side or flank of crystal 9. In the case of a circular crystal 9, lugs 36 are arranged to be diametrically opposite. In the case of a parallelepiped crystal 9, the pair of lugs 36 are arranged to be located on opposite faces. For example, if crystal 9 is rectangular, it thus has two faces extending along the length of crystal 9 and two faces extending along the width of crystal 9. In that case, lugs 36 are either placed on each of the two faces extending along the length of crystal 9 or on each of the two faces extending along the width of crystal 9. For practical reasons, lugs 36 are centred on the faces of crystal 9 as seen in FIG. 4.

Figure 5:
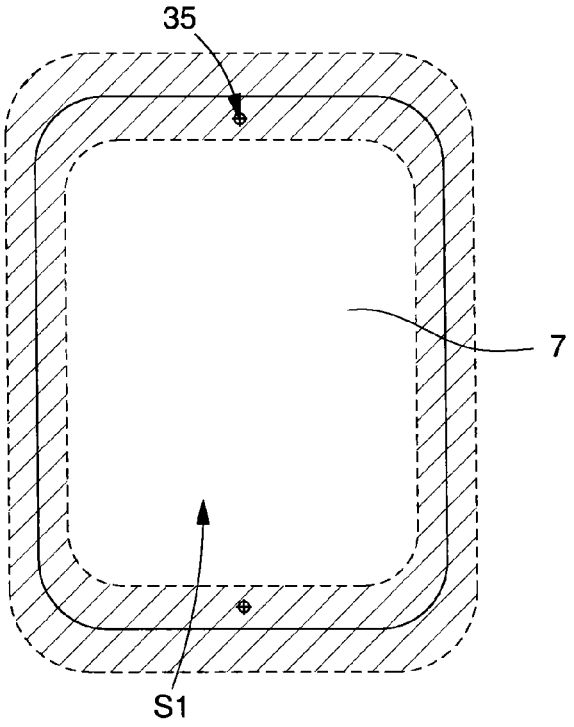
FIGS. 5 to 6 show schematic views of the useful surface of the crystal of the invention and a variant thereof.
Figure 6:
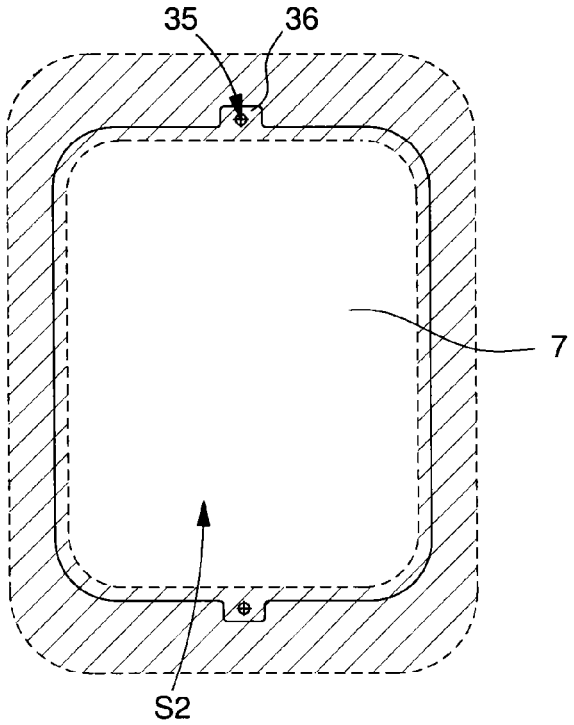

These lugs 36 are thus the areas of crystal 9 on which recesses 35 are formed. This variant thus has the advantage of having a larger useful reading surface as seen in FIG. 6. In fact, recesses 35 into which studs 33 are inserted thus must, for aesthetic reasons, be concealed during assembly. A cap is fixed to crystal 9 for this purpose and conceals the areas of crystal 9 comprising said recesses 35. When recesses 35 are located on the surface of crystal 9, placing the cap in position decreases the useful surface S1 of crystal 9. However, with the lugs according to the variant of the invention, recesses 35 are no longer actually located on surface S2 of crystal 9. As visible in FIGS. 5 and 6, there are two cases shown in which crystal 9 has lugs 36 and does not have lugs 36. It will be noted that for the same sized crystal 9, having lugs 36 means that the position of the cap can be offset and thus a larger useful surface S2 can be obtained than the useful surface S1 for a crystal 9 with no lugs 36 as shown in FIG. 5.

In a second variant, recesses 35 are through recesses. This feature has the advantage of holding crystal 9 better on middle part 5. Indeed, since recesses 35 are through recesses, studs 33 are larger in size and thus offer improved hold.

In a third variant, it is possible to envisage that recesses 35 are not identical. Indeed, it is possible for the method of fabricating middle part 5 and thus studs 33 to allow for the possibility of a variation in position of one or more studs 33 along the axis formed by the two studs 33. In the example of FIG. 4, this is the 6 o'clock-12 o'clock axis. With two circular recesses 35, there exists a risk that a stud 33 is not inserted into its recess. To overcome this problem, recesses 35 are arranged so that crystal 9 is provided with one centred recess 35 and one aligned recess 35, i.e. one of recesses 35 is circular whereas the other is oblong as seen in FIG. 4. Oblong recess 35 extends along the axis formed by the two recesses 35. This configuration has the advantage of tolerating variations in the positions of studs 33 since, during assembly, one of studs 33 is inserted into the circular recess 35 enabling crystal 9 to be centred. Oblong recess 35 enables the second stud 33 to be inserted therein and thus crystal 9 to be aligned. This alignment of crystal 9 occurs even if one of the two studs 33 is not in its ideal position.

It will be clear that various alterations and/or improvements and/or combinations evident to those skilled in the art may be made to the various embodiments of the invention set out above without departing from the scope of the invention defined by the annexed claims.

Of course, it is possible to envisage that the first alignment elements include at least two recesses. These recesses are arranged on the bearing surface of middle part 5 and the second alignment elements include at least two studs located on crystal 9.

What is claimed is:

1. A timepiece including a case formed by a middle part closed by a back cover and by a crystal, said crystal being supported on the middle part, said case forming a housing in which an electronic module is placed, said timepiece further including a display module fixed to a bottom face of the crystal, the electronic module and the display module respectively include first connection points and second connection points so that an electrical connection mechanism connects the first connection points to the second connection points in pairs, wherein said case is further provided with first alignment elements arranged on the middle part and second alignment elements arranged on the crystal, the first alignment elements and the second alignment elements being arranged to cooperate with each other and to be formed so that the first connection points and the second connection points required to be connected to each her in pairs are located facing each other.

2. The timepiece according to claim 1, wherein the first alignment elements include at least two studs, the second alignment elements include a number of recesses at least identical to a number of the studs, the second alignment elements arranged being positioned on said crystal, so that the electronic module connection points and the display module connection points required to be connected in pairs are located facing each other.

3. The timepiece according to claim 2, wherein said recesses are circular.

4. The timepiece according to claim 2, wherein one of said recesses is oblong.

5. The timepiece according to claim 2, wherein said crystal includes at least two projecting portions each extending from one of sides of the crystal, said second alignment elements being arranged on said at least two projecting portions.

6. The timepiece according to claim 5, wherein said at least two projecting portions are arranged on opposite sides of the crystal.

7. The timepiece according to claim 1, wherein the first alignment elements include at least two recesses, the second alignment elements include a number of studs at least identical to a number of the recesses, the first alignment elements arranged being positioned on said crystal so that the first connection points of the electronic module and the second connection points of the display module required to be connected in pairs are located facing each other.

8. The timepiece according claim 7, wherein said at least recesses are circular.

9. The timepiece according to claim 7, wherein one of said at least two recesses is oblong.

10. The timepiece according to claim 7, wherein said crystal includes at least two projecting portions each extending from one of sides of the crystal, said second alignment elements being arranged on said at least two projecting portions.

11. The timepiece according to claim 10, wherein said at least two projecting portions are arranged on opposite sides of the crystal.

12. The timepiece according to claim 1, wherein said crystal includes at least two projecting portions each extending from one of sides of the crystal, said second alignment elements being arranged on said at least two projecting portions.

13. The timepiece according to claim 12, wherein said at least two projecting portions are arranged on opposite sides of the crystal.

14. The timepiece according to claim 13, wherein the electronic module and the display module are physically discrete from each other.

15. A timepiece assembly method, the timepiece including a case formed by a middle part closed by a back cover and by a crystal defining a housing, said method comprising:

taking an electronic module including first connection points and placing the electronic module in said housing;

taking a crystal including an external face and a bottom face onto which a display module including second connection points is fixed, the second connection points being required to cooperate with the first connection points;

wherein said method further comprises:

determining a position of at least one stud arranged on the middle part in relation to the first connection points;

determining a position of the display module relative to the crystal;

forming at least one recess in the crystal according to the position of said at least one stud arranged on the middle part relative to the first connection points; and placing the crystal on the middle part causing said at least one stud to cooperate with said at least one recess and rendering said crystal integral with said middle part.

16. The assembly method according to claim 15, wherein the determining of the position of at least one stud arranged on the middle part relative to the first connection points includes making an optical image of the middle part and measuring a distance of the first connection points relative to said at least one stud acting as a reference.

17. The assembly method according to claim 15, wherein the determining of the position of the display module relative to the crystal includes making an optical image of the crystal.

18. The assembly method according to claim 15, wherein a number of studs is identical to a number of recesses.

19. The assembly method according to claim 15, wherein the middle part includes two studs and the crystal includes two recesses.

20. A timepiece assembly method, the timepiece including a case formed by a middle part closed by a back cover and by a crystal defining a housing, said method comprising:

taking an electronic module including first connection points and placing the electronic module in said housing;

taking a crystal including an external face and a bottom face onto which a display module including second connection points is fixed, the second connection points being required to cooperate with the first connection points;

wherein said method further comprises:

determining a position of at least one stud arranged on the crystal in relation to the first connection points;

determining a position of the electronic module relative to the middle part;

forming at least one recess in the middle part according to the position of said at least one stud arranged in the crystal relative to the second connection points; and placing the crystal on the middle part causing said at least one stud to cooperate with said at least one recess and rendering said crystal integral with said middle part.

21. The assembly method according to claim 20, wherein the determining of the position of at least one stud arranged on the crystal relative to the second connection points includes making an optical image of the crystal and measuring a distance of the second connection points relative to said at least one stud acting as a reference.

22. The assembly method according to claim 20, wherein the determining of the position of the electronic module relative to the middle part includes making an optical image of the middle part.

23. The assembly method according to claim 20, wherein a number of studs is identical to a number of recesses.

24. The assembly method according to claim 20, wherein middle part includes two recesses and the crystal includes two studs.

25. A timepiece assembly method, the timepiece including a case formed by a middle part closed by a back cover and by a crystal defining a housing, said method comprising:

taking an electronic module including first connection points and placing the electronic module in said housing;

taking a crystal including an external face and a bottom face onto which a display module including second connection points is fixed, the second connection points being required to cooperate with the first connection points;

wherein said method further comprises:

determining a position of the display module relative to the crystal;

forming at least one recess in the crystal according to the position of said at east one stud arranged on the middle part relative to the first connection points; and placing the crystal on the middle part causing said at least one stud to cooperate with said a least one recess and rendering said crystal integral with said middle part.

26. The assembly method according to claim 25, wherein the determining of the position of the display module relative to the crystal includes making an optical image of the crystal.

27. The assembly method according to claim 25, wherein a number of studs is identical to a number of recesses.

28. The assembly method according to claim 25, wherein the middle part includes two studs and the crystal includes two recesses.

29. A timepiece assembly method, the timepiece including a case formed by a middle part closed by a back cover and by a crystal defining a housing, said method comprising:

taking an electronic module including first connection points and placing the electronic module in said housing;

taking a crystal including an external face and a bottom face onto which a display module including second connection points is fixed, the second connection points being required to cooperate with the first connection points;

wherein said method further comprises:

determining a position of the electronic module relative to the middle part;

forming at least one recess in the middle part according to a known position of at least one stud arranged on the crystal relative to the second connection points; and placing the crystal on the middle part causing said at least one stud to cooperate with said at least one recess and rendering said crystal integral with said middle part.

30. The assembly method according to claim 29, wherein the determining of the position of the electronic module relative to the middle part includes making an optical image of the middle part.

31. The assembly method according to claim 29, wherein a number of studs is identical to a number of recesses.

32. The assembly method according to claim 29, wherein middle part includes two recesses and the crystal includes two studs.

* * * * *